US009776769B2

(12) United States Patent
Kondo et al.

(10) Patent No.: US 9,776,769 B2
(45) **Date of Patent: *Oct. 3, 2017**

(54) STEAM RELEASE STANDING POUCH AND CONTENT-ENCLOSING STANDING POUCH

(71) Applicant: TOPPAN PRINTING CO., LTD., Tokyo (JP)

(72) Inventors: Hideya Kondo, Tokyo (JP); Hirofumi Kawai, Tokyo (JP)

(73) Assignee: TOPPAN PRINTING CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/169,198

(22) Filed: May 31, 2016

(65) Prior Publication Data

US 2016/0272402 A1 Sep. 22, 2016

Related U.S. Application Data

(63) Continuation of application No. 14/470,363, filed on Aug. 27, 2014, now Pat. No. 9,527,629, which is a (Continued)

(30) Foreign Application Priority Data

Mar. 7, 2012 (JP) ..... 2012-050533

(51) Int. Cl.
*B65D 33/01* (2006.01)
*B65D 75/00* (2006.01)
(Continued)

(52) U.S. Cl.
CPC ..... *B65D 33/01* (2013.01); *B65D 75/008* (2013.01); *B65D 75/5805* (2013.01);
(Continued)

(58) Field of Classification Search
CPC ..... B65D 33/01; B65D 81/34; B65D 75/008; B65D 75/5805; B65D 77/225; B65D 79/005; B65D 81/3461
(Continued)

(56) References Cited

U.S. PATENT DOCUMENTS

2011/0100983 A1 5/2011 Han
2013/0048636 A1 2/2013 Mack ..... 220/203.16
2015/0291342 A1 10/2015 Mack

FOREIGN PATENT DOCUMENTS

JP 4-10079 1/1992
JP 10-101154 4/1998
(Continued)

OTHER PUBLICATIONS

Notice of Allowance issued from the United States Patent and Trademark Office on Aug. 18, 2016 in the related U.S. Appl. No. 14/470,363.
(Continued)

*Primary Examiner* — Jes F Pascua

(57) ABSTRACT

A steam release standing pouch has a structure in which the sealing portion is reliably peeled, and a content sealing standing pouch formed using the pouch. The steam release standing pouch has a first vapor passage portion. The distance between the inner edge of the tip of the vapor passage portion and the center of maximum expansion, which is the center of the portion where expansion is expected to be maximal, is shorter than either the distance between the inner edge of the first upper side portion and the center of maximum expansion or the distance between the inner edge of the first intermediate side portion and the center of maximum expansion.

5 Claims, 6 Drawing Sheets

Related U.S. Application Data continuation of application No. PCT/JP2013/055008, filed on Feb. 26, 2013.

(51) Int. Cl.

| | |
|---|---|
| ***B65D 75/58*** | (2006.01) |
| ***B65D 77/22*** | (2006.01) |
| ***B65D 81/34*** | (2006.01) |
| ***B65D 79/00*** | (2006.01) |

(52) U.S. Cl.

CPC ..... *B65D 77/225* (2013.01); *B65D 79/005* (2013.01); *B65D 81/3461* (2013.01)

(58) Field of Classification Search

USPC ..... 383/100–104

See application file for complete search history.

(56) References Cited

FOREIGN PATENT DOCUMENTS

| | | | |
|---|---|---|---|
| JP | 2001/180762 | | 7/2001 |
| JP | 2001/206458 | | 7/2001 |
| JP | 2005-47598 | | 2/2005 |
| JP | 2005-320023 | | 11/2005 |
| JP | 2006-56526 | | 3/2006 |
| JP | 2006-143237 | | 6/2006 |
| JP | 2006143237 | A * | 6/2006 |
| JP | 2006327590 | A | 12/2006 |
| JP | 2007-297081 | | 11/2007 |
| JP | 2010036968 | A | 2/2010 |
| WO | WO 2013100058 | A1 | 7/2013 |

OTHER PUBLICATIONS

International Search Report mailed May 21, 2013, in corresponding International Patent Application No. PCT/JP2013/055008.

PCT International Preliminary Report on Patentability issued Sep. 9, 2014 in corresponding International Patent Application No. PCT/JP2013/055008.

Korean Office Action dated Mar. 15, 2016 in corresponding Korean Patent Application No. 10-2014-7027584.

Machine translation of the description of JP 2006-143237. Translated on Feb. 16, 2016.

Machine translation of Japanese Document No. 2006-327590 description. Translated on May 30, 2015.

Machine translation of Japanese Document No. 2007-297081 description. Translated on May 30, 2015.

Office Action issued from the United States Patent and Trademark Office on Jun. 4, 2015 in the related U.S. Appl. No. 14/470,363.

Office Action issued from the United States Patent and Trademark Office on Sep. 17, 2015 in the related U.S. Appl. No. 14/470,363.

Office Action issued from the United States Patent and Trademark Office on Feb. 19, 2016 in the related U.S. Appl. No. 14/470,363.

U.S. Appl. No. 14/470,363, filed Aug. 27, 2014, Hideya Kondo et al., Toppan Printing Co., Ltd.

* cited by examiner

STEAM RELEASE STANDING POUCH AND CONTENT-ENCLOSING STANDING POUCH

CROSS-REFERENCE TO RELATED APPLICATIONS

This application is a U.S. continuation application filed under 37 C.F.R. 1.53(b) claiming priority benefit of U.S. application Ser. No. 14/470,363, filed Aug. 27, 2014, pending, which is a continuation, filed under 35 U.S.C. §111(a), of International Patent Application No. PCT/JP2013/055008, filed Feb. 26, 2013, which claims foreign priority to Japanese Patent Application No. 2012-050533, filed Mar. 7, 2012, all of which are incorporated herein by reference.

BACKGROUND

Field

The present invention relates to a steam release standing pouch that has a bag body and a bottom gusset and to a content sealing standing pouch.

Description of Related Art

A pouch of Japanese Laid-Open Utility Model Publication No. 4-10079 has a sealing portion that defines an internal space, a V-shaped sealing portion that is formed at a part of the sealing portion, and a triangular unsealed surface, which is formed at the valley part of the V-shaped sealing portion. In this pouch, an opening is formed by allowing a sealing at the vertex of the V-shaped sealing portion to be peeled when the pressure of the internal space rises. Steam in the internal space of the pouch is discharged outward through the opening.

Japanese Laid-Open Utility Model Publication No. 4-10079 discloses that, in order to appropriately discharge the steam in the internal space, it is necessary to adopt a configuration by which a seal at the vertex of the V-shaped sealing portion is appropriately peeled when the pressure of the internal space rises. More specifically, Japanese Laid-Open Utility Model Publication No. 4-10079 discloses on page 9 that "In other words, even if the inside of the bag is filled with steam and therefore the internal pressure rises, if the V-shaped sealing portion is too close to the end sealing portion (4), a force will not be applied onto the V-shaped sealing portion and will be dispersed over to the entire length of the end seal. There is a possibility that the V-shaped sealing portion will not be opened even if great pressure is applied, and the V-shaped sealing portion will be suddenly opened explosively. As a result, content will be scattered. Therefore, the vertex (A) of the V-shaped sealing portion is required to be set at a position (h1) that is below the end sealing portion (4) by ten millimeters or more."

On the other hand, the present inventors have examined the structure of a pouch that has a sealing portion that is peeled when the pressure of the internal space rises from the viewpoint of more reliably peeling this sealing portion. The inventors have concluded that the structure of the sealing portion still has room for improvement.

It is an objective of the present invention to provide a steam release standing pouch that has a structure in which a sealing portion peels off more reliably and to provide a content sealing standing pouch formed by using this pouch.

SUMMARY (1) The forms of the means for solving the problems include a steam release standing pouch comprising a bag body and a bottom gusset. The steam release standing pouch has a widthwise direction and a height direction. The bag body has a side sealing portion, which is an end in the widthwise direction and has been subjected to a sealing process, and a sealable portion, which is an upper end in the height direction and has not been subjected to a sealing process. The bottom gusset has a gusset sealing portion, which is an end in the widthwise direction and is a lower end in the height direction and has been subjected to a sealing process. The side sealing portion has an upper side portion, a vapor passage portion, and an intermediate side portion and is formed continuously in order of the upper side portion, the vapor passage portion, and the intermediate side portion from the upper edge of the bag body. The vapor passage portion has a recessed portion recessed toward an inside of the bag body in the widthwise direction of the bag body. A distance between an inner edge of the recessed portion of the vapor passage portion and a maximum expansion center, which is a center of a maximum expandable portion of the bag body is shorter than a distance between an inner edge of the upper side portion and the maximum expansion center and shorter than a distance between an inner edge of the intermediate side portion and the maximum expansion center.

As an experiment, the distance between the inner edge of the recessed portion of the vapor passage portion and the center (maximum expansion center) of the maximum expandable portion was made shorter than the distance between the inner edge of the upper side portion and the maximum expansion center and shorter than the distance between the inner edge of the intermediate side portion and the maximum expansion center. As a result, the present inventors confirmed that the frequency at which the vapor passage portion reliably peeled became higher in proportion to a rise in the pressure of the internal space, as compared to a case in which these relationships were not established. This experiment was performed by using the steam release standing pouch in which the internal space was sealed up by allowing the sealable portion to undergo sealing.

In the steam release standing pouch of the aforementioned invention, the distance between the inner edge of the recessed portion and the maximum expansion center is shorter than the distance between the inner edge of the upper side portion and the maximum expansion center and shorter than the distance between the inner edge of the intermediate side portion and the maximum expansion center. Therefore, the vapor passage portion is peeled more reliably. The present inventors infer the reason why the frequency at which the vapor passage portion reliably is peeled becomes higher as follows.

In the steam release standing pouch, the bag body expands radially from the maximum expansion center proportionately with a rise in the pressure of the internal space. At this time, the bag body forms a three-dimensional shape similar to a hemisphere. The amount of expansion of the bag body is greatest at the maximum expansion center and gradually becomes smaller toward each sealing portion that surrounds the internal space. This suggests that a force that acts on the bag body due to a rise in the pressure of the internal space, i.e., a force that acts in directions in which sheets that face each other and that define the internal space of the bag body are separated from each other becomes greater toward the maximum expansion center.

From the foregoing, it is conceivable that the result that the frequency at which the vapor passage portion is reliably peeled is high has been obtained in the steam release standing pouch of the present invention, i.e., in the pouch in which the distance between the inner edge of the recessed portion and the maximum expansion center is shorter than the distance between the inner edge of the upper side portion and the maximum expansion center and shorter than the distance between the inner edge of the intermediate side portion and the maximum expansion center.

(2) Another form of the means is a steam release standing pouch in which the recessed portion has a first recessed portion and a second recessed portion, and the first recessed portion has an upper portion contiguous with the upper side portion, a lower portion contiguous with the intermediate side portion, and a bottom portion contiguous with the upper portion and with the lower portion. The second recessed portion is formed at a bottom portion of the first recessed portion and has an area smaller than an area of the first recessed portion.

(3) Another form of the means is a steam release standing pouch in which the second recessed portion has a bottom portion that is a tip of the recessed portion facing the bag body, and an outer edge of the bottom portion of the second recessed portion includes a linear shape that extends in the height direction of the steam release standing pouch.

(4) Another form of the means is a steam release standing pouch in which an upper outer edge that is an outer edge of the upper portion is formed contiguously with an outer edge of the upper side portion, and includes a linear shape that inclines downwardly in the height direction toward an inside of the widthwise direction. A lower outer edge that is an outer edge of the lower portion is formed contiguously with an outer edge of the intermediate side portion and includes a linear shape that inclines upwardly in the height direction toward an inside of the widthwise direction. The second recessed portion additionally has a first outer edge and a second outer edge. The first outer edge is formed contiguously with the upper outer edge and the outer edge of the bottom portion of the second recessed portion and includes a linear shape that extends in the widthwise direction. The second outer edge is formed contiguously with the lower outer edge and the outer edge of the bottom portion of the second recessed portion and includes a linear shape that extends in the widthwise direction.

(5) Another form of the means is a steam release standing pouch in which a width of the second recessed portion is smaller than a width of the first recessed portion.

(6) Another form of the means is a steam release standing pouch in which the vapor passage portion has a bottom portion that is a tip of the recessed portion facing the bag body, and an outer edge of the bottom portion includes a linear shape that extends in the height direction of the steam release standing pouch.

(7) Another form of the means is a steam release standing pouch in which the bag body has a cuttable portion between the sealable portion and the vapor passage portion in the height direction, and the cuttable portion is formed through the upper side portion. The upper side portion is configured such that a width of a graspable portion, which is above the cuttable portion in the height direction is greater than a width of an intermediate portion, which is below the cuttable portion in the height direction.

(8) Another form of the means is a content sealing standing pouch that includes any of the above described steam release standing pouch in which the sealable portion has been subjected to a sealing process, and a content enclosed in the steam release standing pouch.

DESCRIPTION OF EMBODIMENTS

In the following an embodiment of the present invention will be described.

1. First Embodiment

Figure 1:
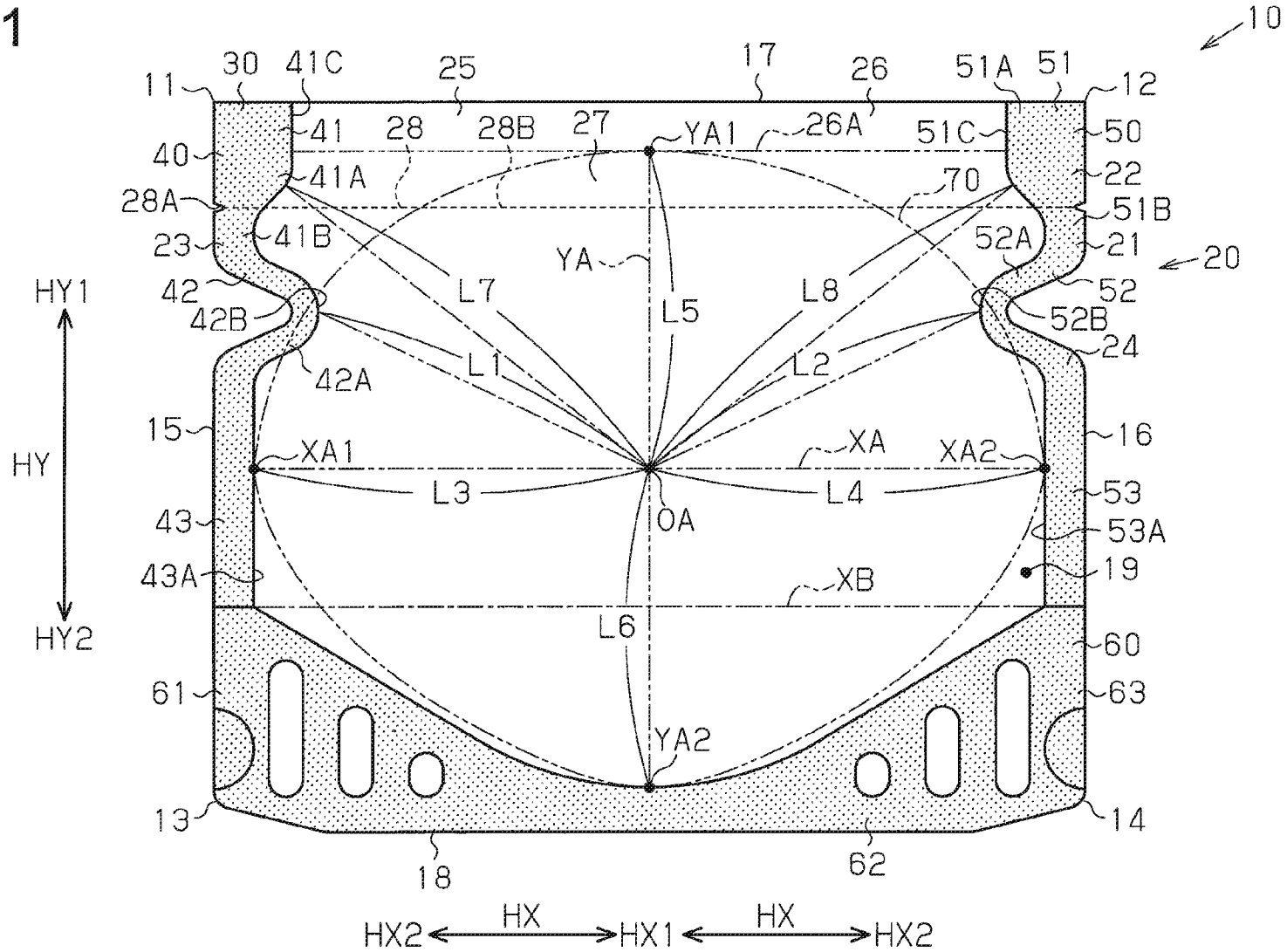
FIG. 1 is a front view of a pouch according to a first embodiment.

A configuration of a steam release pouch 10 will be described with reference to FIG. 1. The dotted regions in FIGS. 1 to 5 represent a side sealing portion 30 and a gusset sealing portion 63, which have been subjected to sealing process in the steam release pouch 10.

The steam release pouch 10 has a widthwise direction HX and a height direction HY.

The widthwise direction HX indicates a direction that defines the outside and the inside when the steam release pouch 10 is viewed from front. The widthwise direction HX perpendicularly intersects the height direction HY. The widthwise direction HX includes an inward direction HX1 and an outward direction HX2.

The inward direction HX1 indicates a direction from the outside toward the inside, i.e., indicates a direction from a first lateral edge 15 or from a second lateral edge 16 toward an internal space 19 in the widthwise direction HX.

The outward direction HX2 indicates a direction from the inside toward the outside, i.e., indicates a direction from the internal space 19 toward the first lateral edge 15 or toward the second lateral edge 16 in the widthwise direction HX.

The height direction HY indicates a direction that defines the upper side and the lower side when the steam release pouch 10 is viewed from front. The height direction HY perpendicularly intersects the widthwise direction HX. The height direction HY includes an upward direction HY1 and a downward direction HY2.

The upward direction HY1 indicates a direction from the lower side toward the upper side, i.e., indicates a direction from the lower edge 18 toward the upper edge 17 in the height direction HY.

The downward direction HY2 indicates a direction from the upper side toward the lower side, i.e., indicates a direction from the upper edge 17 toward the lower edge 18 in the height direction HY.

The steam release pouch 10 has a form as a standing pouch. In the steam release pouch 10, all of the edge except a part at which the opening 27 is formed has been subjected to a sealing process.

The steam release pouch 10 has a bag body 20 and a bottom gusset 60.

The steam release pouch 10 is made of a laminated sheet. The laminated sheet has an outermost layer, an intermediate layer, and an innermost layer. The outermost layer is the most external layer in the steam release pouch 10 and is made of a polyethylene terephthalate layer. The innermost layer is the most internal layer in the steam release pouch 10 and is made of a non-oriented polypropylene layer. The intermediate layer is composed of a print layer, a first adhesive layer, an oriented nylon layer, and a second adhesive layer. The printed layer is formed inside the outermost layer. The first adhesive layer is formed inside the printed layer. The oriented nylon layer is formed inside the first adhesive layer. The second adhesive layer is formed inside the oriented nylon layer. The innermost layer is formed inside the second adhesive layer. The printed layer has pictures, item descriptions and the like on its outer surface.

The steam release pouch 10 has a first vertex 11, a second vertex 12, a third vertex 13, a fourth vertex 14, a first lateral edge 15, a second lateral edge 16, an upper edge 17, a lower edge 18, and an internal space 19.

The first lateral edge 15 forms an edge from the first vertex 11 to the third vertex 13 in the steam release pouch 10. The second lateral edge 16 forms an edge from the second vertex 12 to the fourth vertex 14 in the steam release pouch 10. The upper edge 17 forms an edge from the first vertex 11 to the second vertex 12 in the steam release pouch 10. The lower edge 18 forms an edge from the third vertex 13 to the fourth vertex 14 in the steam release pouch 10.

The first lateral edge 15 and the upper edge 17 are contiguous to each other at the first vertex 11. The first lateral edge 15 and the lower edge 18 are contiguous to each other at the third vertex 13. The second lateral edge 16 and the upper edge 17 are contiguous to each other at the second vertex 12. The second lateral edge 16 and the lower edge 18 are contiguous to each other at the fourth vertex 14.

The bag body 20 has a first bag portion 21, a second bag portion 22, a first lateral section 23, a second lateral section 24, an upper portion 25, a cuttable portion 28, and a side sealing portion 30.

The first bag portion 21 is formed contiguously with the second bag portion 22 through the cuttable portion 28. The first bag portion 21 is formed contiguously with the bottom gusset 60. A borderline XB represents a boundary between the first bag portion 21 and the bottom gusset 60.

The second bag portion 22 has a sealable portion 26 and the opening 27.

The sealable portion 26 is formed to include the upper edge 17. After content is put into the internal space 19 through the opening 27, the sealable portion 26 is sealed along a sealing line 26A.

The first lateral section 23 is a part of the first lateral edge 15 that corresponds to the bag body 20.

The second lateral section 24 is a part of the second lateral edge 16 that corresponds to the bag body 20.

The upper portion 25 is formed to include the upper edge 17.

The cuttable portion 28 has a notch 28A and a guide line 28B. The notch 28A is formed at a boundary between the first bag portion 21 and the second bag portion 22. The notch 28A functions as a starting point when the second bag portion 22 is separated from the first bag portion 21 along the guide line 28B. The guide line 28B has a linear shape by which the notches 28A formed at the first and second lateral edges 15 and 16 are connected together. The guide line 28B is formed by applying half-cutting onto the film forming the bag body 20 by use of a laser.

The side sealing portion 30 has a first side sealing portion 40 and a second side sealing portion 50. The side sealing portion 30 is formed by thermal welding.

The first side sealing portion 40 seals the first lateral section 23. The first side sealing portion 40 has a first upper side portion 41, a first vapor passage portion 42, and a first intermediate side portion 43.

The first upper side portion 41 seals the area that surrounds the first vertex 11. The first upper side portion 41 has a first graspable portion 41A and a first intermediate portion 41 B.

The first graspable portion 41A is located above the cuttable portion 28 in the upward direction HY1. A sealing width that is the width of the first graspable portion 41A is greater than a sealing width that is the width of the first intermediate portion 41B. The first intermediate portion 41B is located below the cuttable portion 28 in the downward direction HY2. The first intermediate portion 41B is formed contiguously with the first vapor passage portion 42.

The first vapor passage portion 42 functions to discharge steam generated in the internal space 19 from the internal space 19 to the outside. The first vapor passage portion 42 is formed contiguously with the first intermediate side portion 43. The first vapor passage portion 42 has the same sealing strength as other sealing portions. The first vapor passage portion 42 has a left recessed portion 42A. The left recessed portion 42A has a shape recessed in the inward direction HX1 of the bag body 20.

The first intermediate side portion 43 is formed between the first vapor passage portion 42 and the borderline XB.

The second side sealing portion 50 seals the second lateral section 24. The second side sealing portion 50 has a second upper side portion 51, a second vapor passage portion 52, and a second intermediate side portion 53.

The second upper side portion 51 seals the area that surrounds the second vertex 12. The second upper side portion 51 has a second graspable portion 51A and a second intermediate portion 51B.

The second graspable portion 51A is located above the cuttable portion 28 in the upward direction HY1. A sealing width that is the width of the second graspable portion 51A is greater than a sealing width that is the width of the second intermediate portion 51B. The second intermediate portion 51B is located below the cuttable portion 28 in the downward direction HY2. The second intermediate portion 51B is formed contiguously with the second vapor passage portion 52.

The second vapor passage portion 52 functions to discharge steam generated in the internal space 19 from the internal space 19 to the outside. The second vapor passage portion 52 is formed contiguously with the second intermediate side portion 53. The second vapor passage portion 52 has the same sealing strength as other sealing portions. The second vapor passage portion 52 has a right recessed portion 52A. The right recessed portion 52A has a shape recessed in the inward direction HX1 of the bag body 20.

The second intermediate side portion 53 is formed between the second vapor passage portion 52 and the borderline XB.

The bottom gusset 60 supports the bag body 20. The bottom gusset 60 has a gusset lateral section 61, a gusset lower portion 62, and the gusset sealing portion 63.

The gusset lateral section 61 is formed to include a part of the first and second lateral edges 15 and 16 that is below the borderline XB in the downward direction HY2. The gusset lower portion 62 is formed to include the lower edge 18.

The gusset sealing portion 63 seals the gusset lateral section 61 and the gusset lower portion 62. The gusset sealing portion 63 is formed by thermal welding.

Herein, the steam release pouch 10 is defined as follows.

The middle point of the sealing line 26A is defined as an upper middle point YA1.

The intersection between a perpendicular that downwardly follows the downward direction HY2 from the upper middle point YA1 and the gusset sealing portion 63 is defined as a lower middle point YA2.

In FIG. 1, the line segment that connects the upper middle point YA1 and the lower middle point YA2 together is defined as a first center line YA.

The middle point of the first center line YA is defined as a maximum expansion center OA. The maximum expansion center OA is located at the center of a maximum expandable portion 70. The maximum expandable portion 70 shows a part that is the greatest in the amount of expansion of the bag body 20 and the bottom gusset 60 when the pressure of the internal space 19 rises.

The straight line that passes through the maximum expansion center OA and that is parallel to the sealing line 26A is defined as a second center line XA.

The intersection between the second center line XA and the inner edge 43A of the first intermediate side portion 43 is defined as a first inner-edge middle point XA1.

The intersection between the second center line XA and the inner edge 53A of the second intermediate side portion 53 is defined as a second inner-edge middle point XA2.

The distance between the maximum expansion center OA and the inner edge 42B of the tip of the left recessed portion 42A is defined as a first distance L1.

The distance between the maximum expansion center OA and the inner edge 52B of the tip of the right recessed portion 52A is defined as a second distance L2.

The distance between the maximum expansion center OA and the first inner-edge middle point XA1 is defined as a third distance L3.

The distance between the maximum expansion center OA and the second inner-edge middle point XA2 is defined as a fourth distance L4.

The distance between the maximum expansion center OA and the upper middle point YA1 is defined as a fifth distance L5.

The distance between the maximum expansion center OA and the lower middle point YA2 is defined as a sixth distance L6.

The distance between the maximum expansion center OA and the inner edge 41C of the first upper side portion 41 is defined as a seventh distance L7.

The distance between the maximum expansion center OA and the inner edge 51C of the second upper side portion 51 is defined as an eighth distance L8.

The first distance L1 to the eighth distance L8 have the following relationships, respectively.

The first distance L1 and the second distance L2 are equal to each other (L1=L2). Each of the first and second distances L1 and L2 is shorter than the third distance L3 and shorter than the fourth distance L4 (L1<L3, L4; L2<L3, L4). Each of the first and second distances L1 and L2 is shorter than the seventh distance L7 and shorter than the eighth distance L8 (L1<L7, L8; L2<L7, L8).

The third distance L3 and the fourth distance L4 are equal to each other (L3=L4). Each of the third and fourth distances L3 and L4 is shorter than the seventh distance L7 and shorter than the eighth distance L8 (L3<L7, L8; L4<L7, L8).

The fifth distance L5 and the sixth distance L6 are equal to each other (L5=L6).

The seventh distance L7 and the eighth distance L8 are equal to each other (L7=L8).

Figure 2:
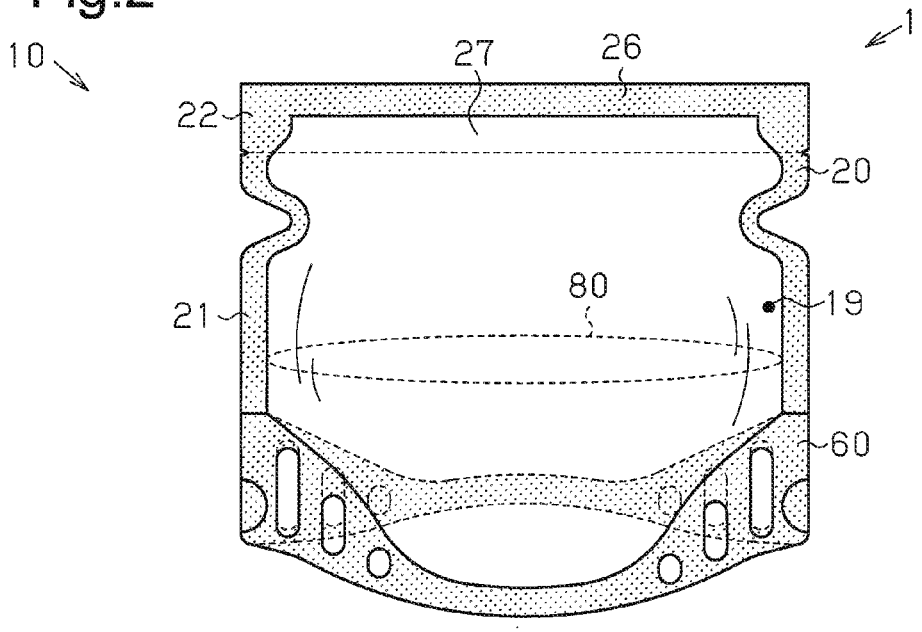
FIG. 2 is a diagram of a content sealing pouch formed by sealing content into the pouch of FIG. 1.

The structure of the content sealing pouch 1 will be described with reference to FIG. 2.

The content sealing pouch 1 has the steam release pouch 10 and a content 80. In the steam release pouch 10, the sealable portion 26 of the opening 27 is sealed in a state in which the content 80 is accommodated in the internal space 19. The content 80 is sauce.

Figure 3:
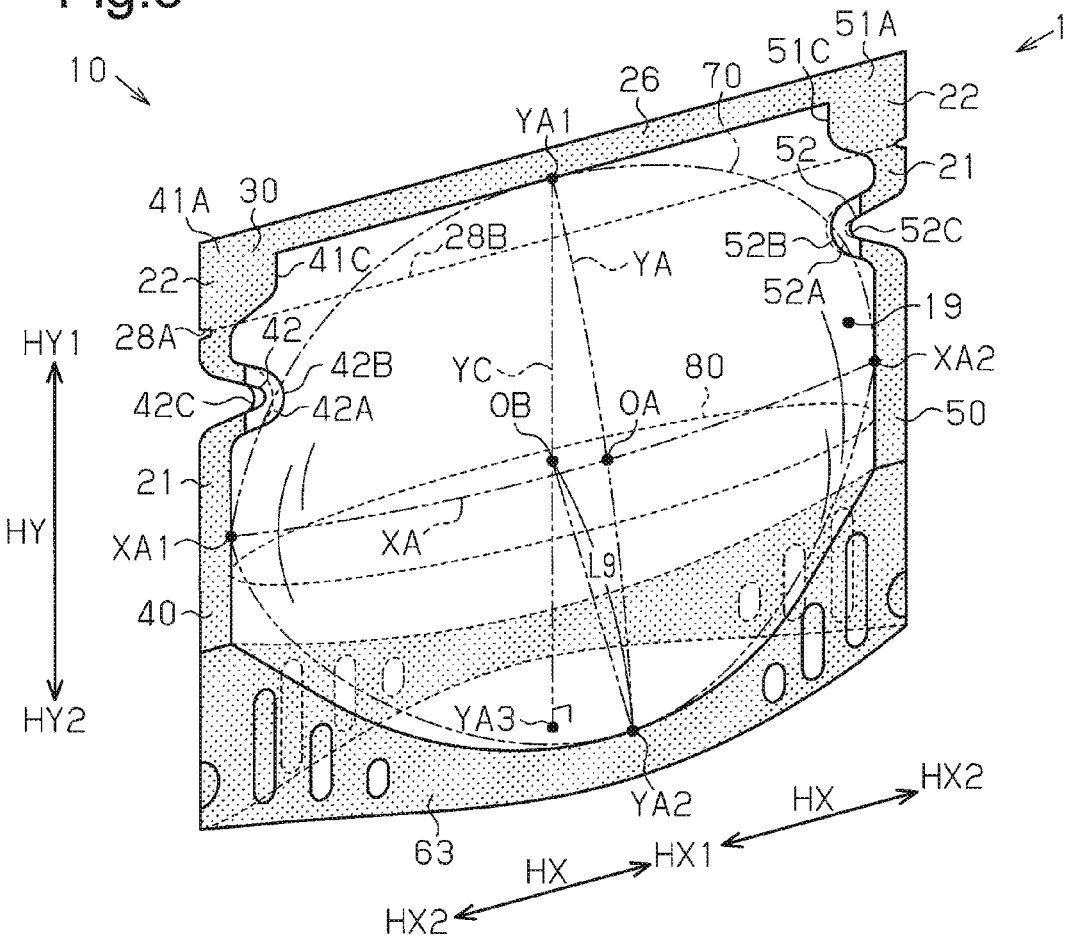
FIG. 3 is a perspective view of the content sealing pouch of FIG. 2, when its internal space and the outside communicate with each other.

The ninth distance L9 will be described with reference to FIG. 3.

The intersection between a perpendicular that downwardly follows the downward direction HY2 from the upper middle point YA1 and the bottom gusset 60 is defined as a lower middle point YA3.

The line segment that connects the upper middle point YA1 and the lower middle point YA3 together is defined as a third center line YC.

The distance between the middle point OB and the lower middle point YA2 is defined as a ninth distance L9.

The ninth distance L9 is longer than the first distance L1 and larger than the second distance L2 shown in FIG. 1 (L9>L1, L2).

The distance between the middle point OB and the inner edge 42B of the tip of the left recessed portion 42A is shorter than the distance between the middle point OB and the first inner-edge middle point XA1. The distance between the middle point OB and the inner edge 42B of the tip of the left recessed portion 42A is shorter than the distance between the middle point OB and the inner edge 41C of the first upper side portion 41.

The distance between the middle point OB and the inner edge 52B of the tip of the right recessed portion 52A is shorter than the distance between the middle point OB and the second inner-edge middle point XA2. The distance between the middle point OB and the inner edge 52B of the tip of the right recessed portion 52A is shorter than the distance between the middle point OB and the inner edge 51C of the second upper side portion 51.

Operation of the content sealing pouch 1 will be described.

Steam is generated in the internal space 19 by heating the content sealing pouch 1 in a microwave oven. Therefore, the pressure of the internal space 19 rises. The bag body 20 and the bottom gusset 60 radially expand from the maximum expansion center OA when the pressure of the internal space 19 rises. At this time, the bag body 20 forms a three-dimensional shape similar to a hemisphere. The amount of expansion of the bag body 20 and the bottom gusset 60 are greatest at the maximum expansion center OA and gradually become smaller toward each sealing portion that surrounds the internal space 19.

A force that acts on the bag body 20 and on the bottom gusset 60 due to a rise in the pressure of the internal space 19, i.e., a force that acts in directions in which sheets that face each other and that define the internal space 19 are separated from each other is considered to become greater toward the maximum expansion center OA.

Therefore, the first vapor passage portion 42 is peeled earliest in the first side sealing portion 40. At this time, a first opening 42C is formed in the content sealing pouch 1. On the other hand, the second vapor passage portion 52 is peeled earliest in the second side sealing portion 50. At this time, a second opening 52C is formed in the content sealing pouch 1. Steam generated in the internal space 19 is discharged to the outside through the first opening 42C and through the second opening 52C. Therefore, a rise in the internal pressure of the internal space 19 becomes slow and is stopped in a short time.

After ending the heating of the content sealing pouch 1, the user takes the content sealing pouch 1 out of the microwave oven while holding the first graspable portion 41A and the second graspable portion 51A.

The user separates the second bag portion 22 from the first bag portion 21 along the guide line 28B with the notch 28A as a starting point and takes the content 80 out of the internal space 19.

A manufacturing process of the content sealing pouch 1 will be described with reference to FIGS. 4(*a*)-4(*c*) and FIGS. 5(*a*)-5(*c*).

Figure 4A:
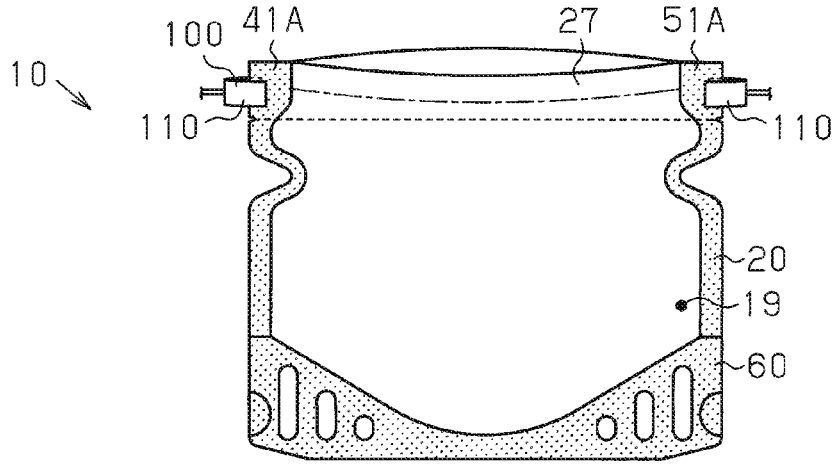
FIGS. 4(*a*) through 4(*c*) are diagrams showing a process for manufacturing the content sealing pouch of FIG. 2, where FIG. 4(*a*) is a front view of the pouch in which an opening has been opened, FIG. 4(*b*) is a front view of the pouch in which a nozzle of a filler has been inserted in the opening, and FIG. 4(*c*) is a front view of the pouch in which content has been accommodated in the internal space.
Figure 4B:
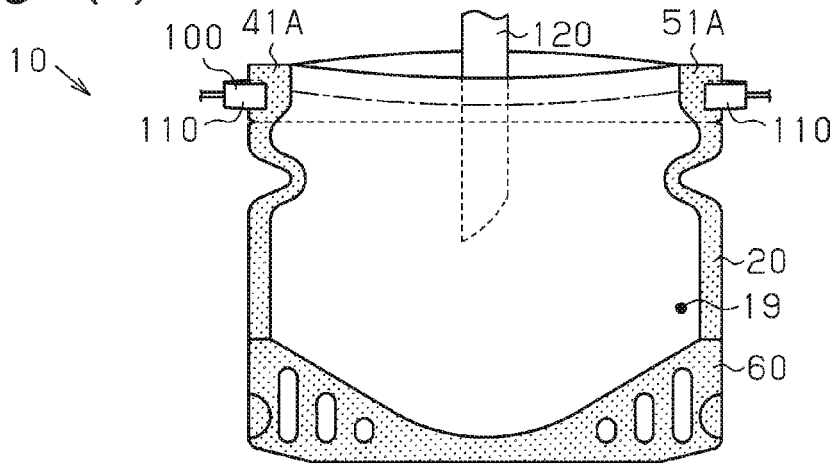
Figure 4C:
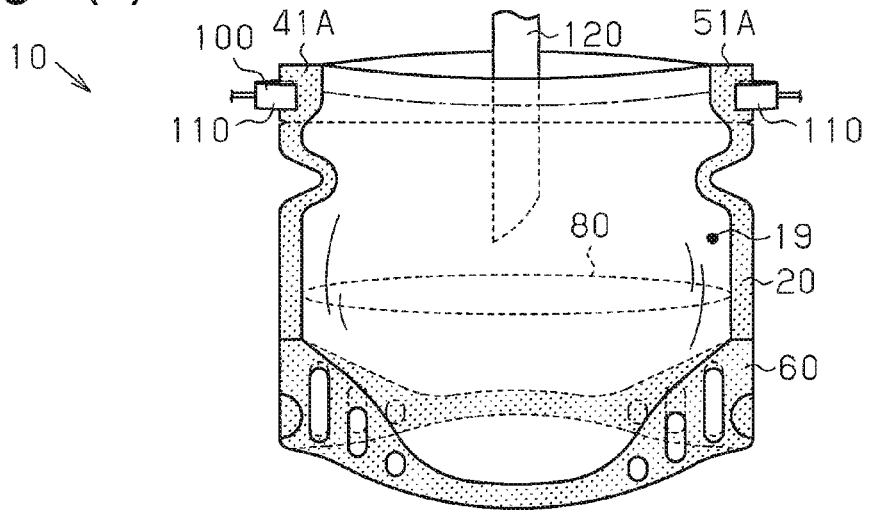
Figure 5A:
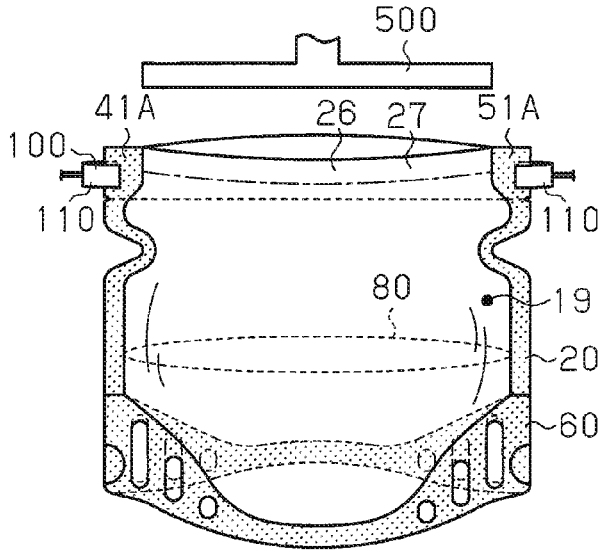
FIGS. 5(*a*) through 5(*c*) are diagrams showing a process for manufacturing the content sealing pouch of FIG. 2, where FIG. 5(*a*) is a front view of the pouch in which the opening has not yet undergone a sealing process, FIG. 5(*b*) is a front view of the pouch in which the opening is undergoing the sealing process, and FIG. 5(*c*) is a front view of the pouch in which the opening has already undergone the sealing process.
Figure 5B:
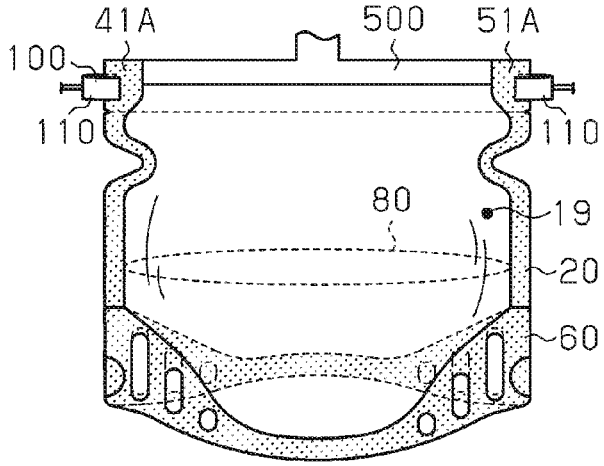
Figure 5C:
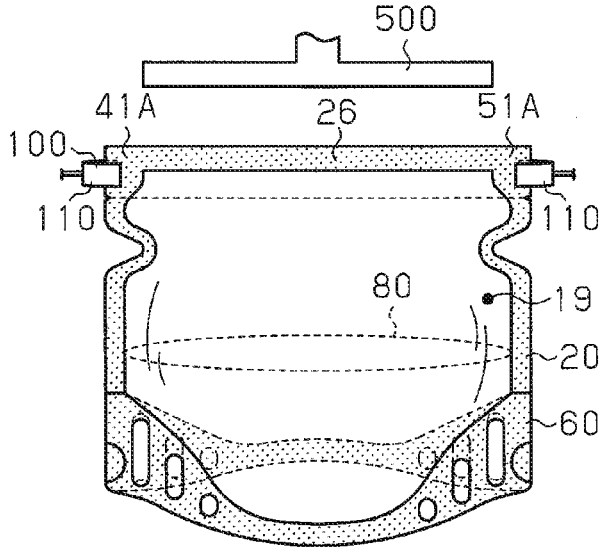

The manufacturing process of the content sealing pouch 1 includes a first step, a second step (FIG. 4(*a*)), a third step (FIG. 4(*b*)), a fourth step (FIG. 4(*c*)), a fifth step (FIG. 5(*a*)), a sixth step (FIG. 5(*b*)), and a seventh step (FIG. 5(*c*)).

At the first step, the steam release pouch 10 is manufactured.

At the second step, the first graspable portion 41A and the second graspable portion 51A of the steam release pouch 10 are chucked with a chuck 110 of the filler 100.

The steam release pouch 10 is transferred to a filling process line, in which it is filled with the content 80, in a state shown in FIG. 4(*a*). The opening 27 is opened by a suction cup (not shown) at a predetermined position in the filling process line.

At the third step, a nozzle 120 is inserted into the opening 27 as shown in FIG. 4(*b*). The nozzle 120 serves to fill the internal space 19 with the content 80.

At the fourth step, the filling operation is ended by filling the internal space 19 with a predetermined amount of content 80 as shown in FIG. 4(*c*). After ending the filling of the internal space 19 with the content 80, the nozzle 120 is pulled out from the opening 27.

At the fifth step, the steam release pouch 10 is transferred to the sealing process line while the first graspable portion 41A and the second graspable portion 51A of the steam release pouch 10 are being chucked with the chuck 110 of the filler 100 as shown in FIG. 5(*a*).

At the sixth step, the seal device 500 sandwiches the sealable portion 26 at a predetermined position in the sealing process line as shown in FIG. 5(*b*). The sealable portion 26 is thus subjected to a sealing process.

At the seventh step, after ending the sealing process, the seal device 500 cancels the sandwiched state of the sealable portion 26 as shown in FIG. 5(*c*).

The steam release pouch 10 of the first embodiment achieves the following advantages.

(1) The first distance L1, which is the distance between the inner edge 42B of the tip of the left recessed portion 42A and the maximum expansion center OA, is shorter than the seventh distance L7, which is the distance between the inner edge 41C of the first upper side portion 41 and the maximum expansion center OA. Additionally, the first distance L1 is shorter than the third distance L3, which is the distance between the inner edge 43A of the first intermediate side portion 43 and the maximum expansion center OA. According to this configuration, the frequency at which the first vapor passage portion 42 is reliably peeled becomes higher in proportion to a rise in the pressure of the internal space 19, as compared to a case in which these relationships are not established.

(2) The second distance L2, which is the distance between the inner edge 52B of the tip of the right recessed portion 52A and the maximum expansion center OA, is shorter than the eighth distance L8, which is the distance between the inner edge 51C of the second upper side portion 51 and the maximum expansion center OA. Additionally, the second distance L2 is shorter than the fourth distance L4, which is the distance between the inner edge 53A of the second intermediate side portion 53 and the maximum expansion center OA. According to this configuration, the frequency at which the second vapor passage portion 52 is reliably peeled becomes higher in proportion to a rise in the pressure of the internal space 19 as compared to a case in which these relationships are not established.

(3) The first side sealing portion 40 has the first graspable portion 41A. The second side sealing portion 50 has the second graspable portion 51A. According to this configuration, in the manufacturing process of the content sealing pouch 1, it is possible to easily hold the bag body 20 by means of the chuck 110 of the filler 100. In other words, it is possible to fill the internal space 19 with the content 80 without changing the structure of the conventional filler 100 even if it is the steam release pouch 10 having the first vapor passage portion 42 and the second vapor passage portion 52.

2. Second Embodiment

Figure 6:
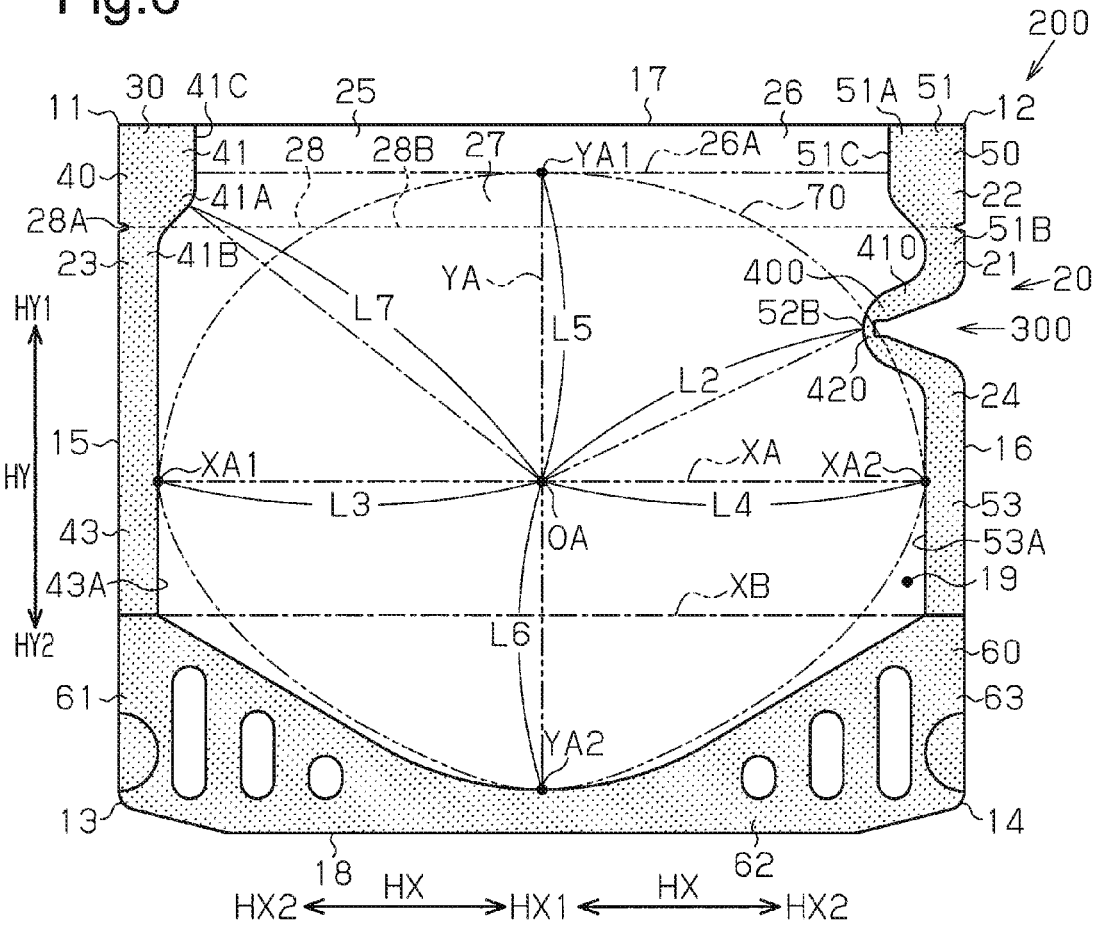
FIG. 6 is a front view of a pouch according to a second embodiment.

A steam release pouch 200 according to a second embodiment shown, for example, in FIG. 6 differs chiefly in the following respect from the steam release pouch 10 according to the first embodiment shown, for example, in FIG. 1. In detail, the steam release pouch 10 of the first embodiment has the first vapor passage portion 42 and the second vapor passage portion 52. On the other hand, the steam release pouch 200 of the present embodiment has a vapor passage portion 300. Points of the present embodiment differing from the steam release pouch 10 of the first embodiment will be hereinafter described in detail. The dotted regions shown in FIGS. 6 to 9 represent the side sealing portion 30 and the gusset sealing portion 63 that are sections to which sealing has been applied in the steam release pouch 200.

The configuration of the steam release pouch 200 will be described with reference to FIG. 6.

The steam release pouch 200 has a form as a standing pouch. The steam release pouch 200 has a vapor passage portion 300.

Figure 7:
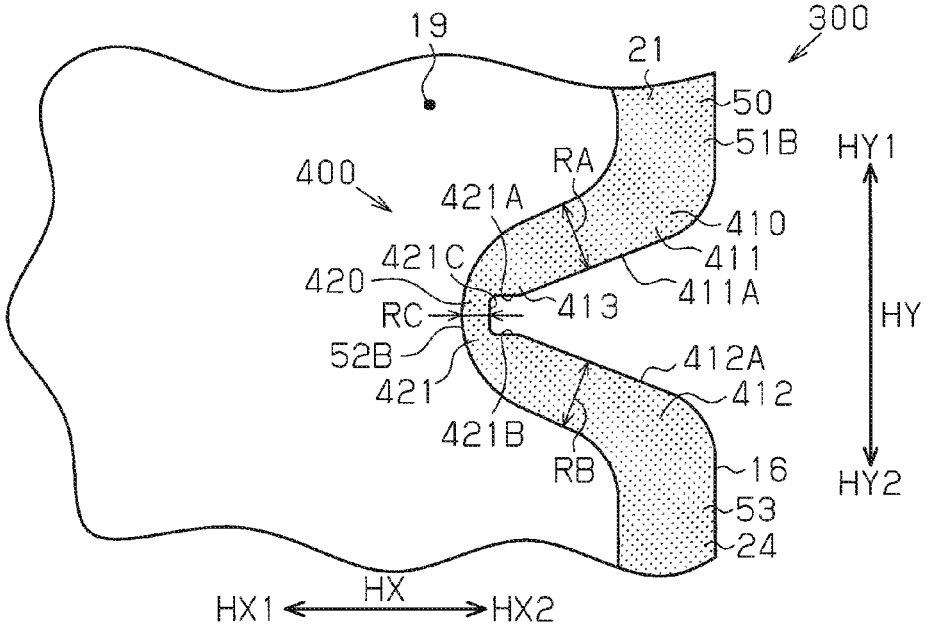
FIG. 7 is an enlarged view of the pouch of FIG. 6, showing a vapor passage portion.

A detailed configuration of the vapor passage portion 300 will be described with reference to FIG. 7.

The vapor passage portion 300 functions to discharge steam generated in the internal space 19 from the internal space 19 to the outside. The vapor passage portion 300 has a recessed portion 400. The recessed portion 400 has a shape recessed in the inward direction HX1. The recessed portion 400 has a first recessed portion 410 and a second recessed portion 420.

The first recessed portion 410 has an upper portion 411, a lower portion 412, and a bottom portion 413. The upper portion 411 is formed contiguously with the second intermediate portion 51B. The upper portion 411 has an upper outer edge 411A.

The upper outer edge 411A is formed contiguously with the outer edge of the second intermediate portion 51B. The upper outer edge 411A inclines toward the inward direction HX1 in the downward direction HY2. The upper outer edge 411A has a linear shape. The upper outer edge 411A has a first sealing width RA. The first sealing width RA is a width between the upper outer edge 411A and the inner edge 52B facing the upper outer edge 411A.

The lower portion 412 is formed contiguously with the second intermediate side portion 53. The lower portion 412 has a lower outer edge 412A.

The lower outer edge 412A is formed contiguously with the outer edge of the second intermediate side portion 53. The lower outer edge 412A inclines toward the inward direction HX1 in the upward direction HY1. The lower outer edge 412A has a linear shape. The lower outer edge 412A has a second sealing width RB. The second sealing width RB is a width between the lower outer edge 412A and the inner edge 52B facing the lower outer edge 412A.

The bottom portion 413 is formed contiguously with the upper portion 411 and with the lower portion 412.

The second recessed portion 420 is formed contiguously with the bottom portion 413 of the first recessed portion 410. The second recessed portion 420 has an area smaller than the first recessed portion 410. The second recessed portion 420 has a bottom portion 421.

The bottom portion 421 is a part including ends of the upper and lower outer edges 411A and 412A that are closer to the inward direction HX1. The bottom portion 421 has a first outer edge 421A, a second outer edge 421 B, and a bottom outer edge 421C.

The first outer edge 421A is formed contiguously with the upper outer edge 411A and with the bottom outer edge 421C. The first outer edge 421A has a shape that extends in the widthwise direction HX. The first outer edge 421A has a linear shape.

The second outer edge 421B is formed contiguously with the lower outer edge 412A and with the bottom outer edge 421C. The second outer edge 421B has a shape that extends in the widthwise direction HX. The second outer edge 421B has a linear shape.

The bottom outer edge 421C is formed contiguously with the first outer edge 421A and with the second outer edge 421B. The bottom outer edge 421C has a shape that extends in the height direction HY. The bottom outer edge 421C has a linear shape.

The bottom outer edge 421C has a third sealing width RC.

The third sealing width RC is a width between the bottom outer edge 421C and the inner edge 52B facing the bottom outer edge 421C. The third sealing width RC is smaller than the first sealing width RA and smaller than the second sealing width RB.

Figure 8:
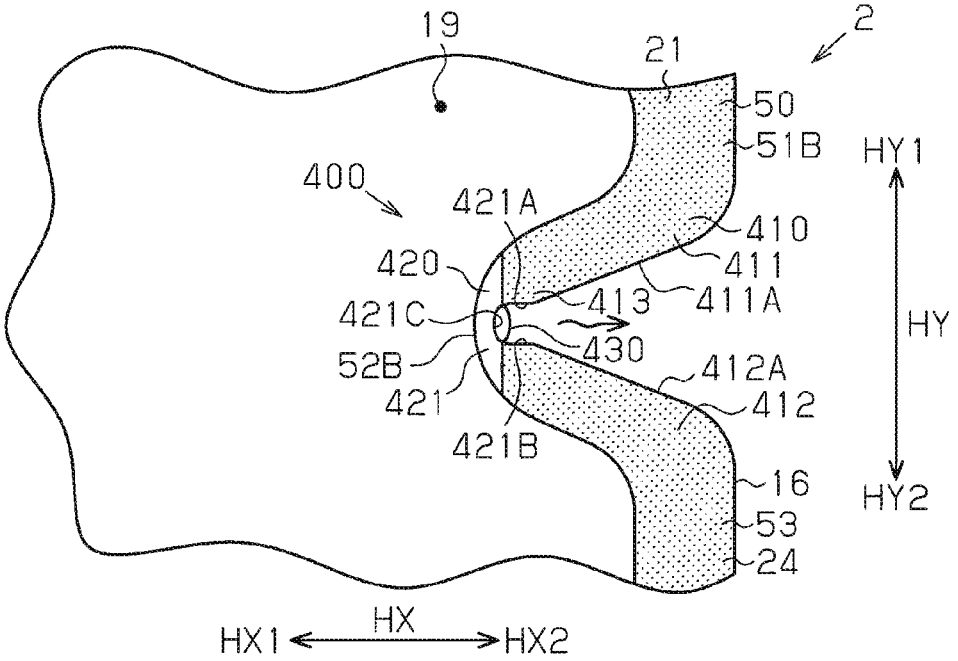
FIG. 8 is an enlarged view of the vapor passage portion of FIG. 7 when the internal space and the outside communicate with each other.

Operation of the steam release pouch 200 will be described with reference to FIGS. 8 and 9.

The content sealing pouch 2 is manufactured by use of the steam release pouch 200 through the same process as the process shown in the first embodiment.

Steam is generated in the internal space 19 by heating the content sealing pouch 2 in a microwave oven. Therefore, the pressure of the internal space 19 rises.

The vapor passage portion 300 is peeled earliest in the second side sealing portion 50 according to the same principle as the content sealing pouch 1 shown in the first embodiment. More specifically, a sealing portion that corresponds to the second recessed portion 420 is peeled as shown in FIG. 8. Therefore, an opening 430 is formed in the vapor passage portion 300. Steam generated in the internal space 19 is discharged to the outside through the opening 430. Therefore, a rise in the internal pressure of the internal space 19 becomes slow and is stopped in a short time.

Figure 9:
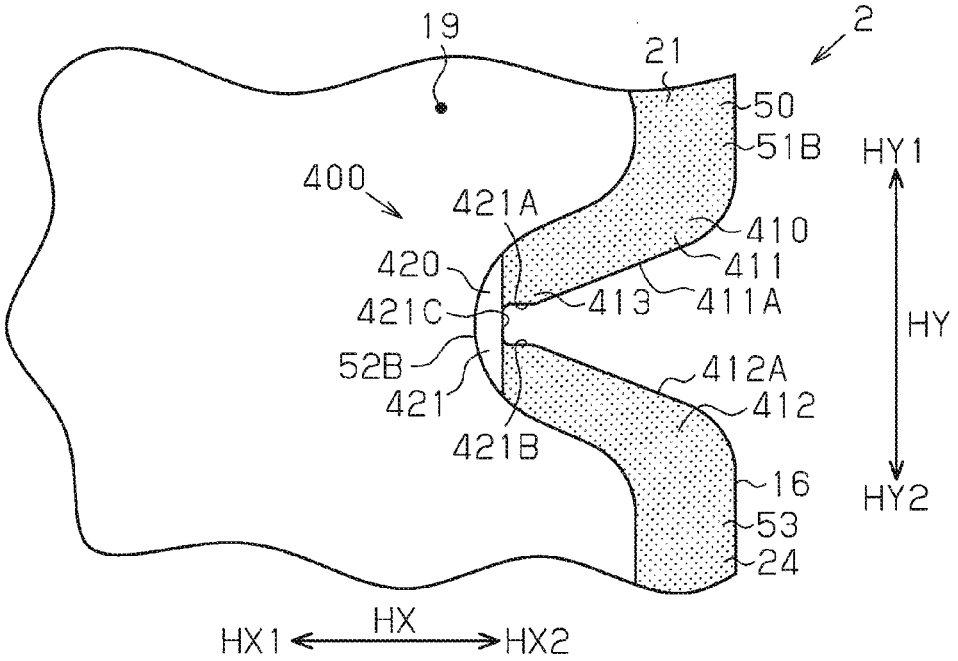
FIG. 9 is an enlarged view of the vapor passage portion of FIG. 7 showing a state in which the opening has been closed.

As shown in FIG. 9, steam generated in the internal space 19 is discharged to the outside through the opening 430, and then sealing portions of the second recessed portion 420 that have been peeled are closely fastened together by the surface tension of water drops adhering thereto. Therefore, the opening 430 is closed.

The steam release pouch 200 of the present embodiment achieves the following advantage in addition to the aforementioned advantages (1) to (3).

(4) The steam release pouch 200 has the vapor passage portion 300. The vapor passage portion 300 has a second recessed portion 420. The second recessed portion 420 has the bottom outer edge 421C. The bottom outer edge 421C has the linear shape that extends in the height direction HY.

Therefore, in the steam release pouch 200, steam generated in the internal space 19 is discharged to the outside through the opening 430, and then sealing portions of the second recessed portion 420 that have been peeled are easily fastened closely together by the surface tension of water drops. Therefore, in the steam release pouch 200, steam generated in the internal space 19 is discharged to the outside through the opening 430, and then the opening 430 is easily closed. Therefore, in the steam release pouch 200, content does not easily leak to the outside from the internal space 19 through the opening 430 when the content sealing pouch 2 is heated in a microwave oven and is then carried by the user.

When a linearly-shaped outer edge that has a shape of the vapor passage portion 300 and that extends in the height direction HY is formed at a position facing the inner edge 52B of the tip of the second recessed portion 420, it has been confirmed by experiments that the frequency at which the opening 430 is appropriately closed rises.

3. Other Embodiments

The steam release standing pouch and the content sealing pouch include embodiments other than the first embodiment and the second embodiment. Modifications of the first and second embodiments will be hereinafter shown as other embodiments of the steam release standing pouch and of the content sealing pouch. The following modifications can be combined with each other within a technically consistent range.

- The bag body 20 of the first embodiment has the first vapor passage portion 42 and the second vapor passage portion 52. On the other hand, the bag body of a modification has either one of the first and second vapor passage portions 42 and 52.
- The first and second vapor passage portions 42 and 52 of the first embodiment have the same sealing strength as the other sealing portions. On the other hand, the first and second vapor passage portions 42 and 52 of a modification have sealing strength weaker than the other sealing portions.
- The first and second distances L1, L2 and the fifth and sixth distances L5, L6 of the first embodiment can be designed to have an arbitrary relationship. Preferably, each of the first and second distances L1 and L2 is shorter than the fifth distance L5 and shorter than the sixth distance L6 (L1<L5, L6; L2<L5, L6).
- The third and fourth distances L3, L4 and the fifth and sixth distances L5, L6 of the first embodiment can be designed to have an arbitrary relationship. Preferably, each of the third and fourth distances L3, L4 is shorter than the fifth distance L5 and shorter than the sixth distance L6 (L3<L5, L6; L4<L5, L6).

The bag body 20 of the second embodiment has the vapor passage portion 300 in the second side sealing portion 50. On the other hand, the bag body of a modification additionally has a vapor passage portion having the same configuration as the vapor passage portion 300 at the position facing the vapor passage portion 300 in the first side sealing portion 40.

The vapor passage portion 300 of the second embodiment has the first recessed portion 410. The first recessed portion 410 has the upper outer edge 411A and the lower outer edge 412A. The upper outer edge 411A inclines toward the inward direction HX1 in the downward direction HY2. The lower outer edge 412A inclines toward the inward direction HX1 in the upward direction HY1. On the other hand, an upper outer edge and a lower outer edge of a modification have linear shapes, respectively, that extend in the widthwise direction HX.

The vapor passage portion 300 of the second embodiment has the first recessed portion 410 and the second recessed portion 420. On the other hand, a vapor passage portion of a modification does not have the second recessed portion 420. The vapor passage portion of the modification has a bottom outer edge in addition to the upper outer edge 411A and the lower outer edge 412A. The bottom outer edge is formed contiguously with the upper outer edge 411A and with the lower outer edge 412A. The bottom outer edge has the linear shape that extends in the height direction HY.

The vapor passage portion 300 of the second embodiment has the second recessed portion 420. The second recessed portion 420 has the first outer edge 421A, the second outer edge 421B, and the bottom outer edge 421C. On the other hand, in a second recessed portion of a modification, at least one of the first outer edge 421A and the second outer edge 421B is excluded.

The steam release pouch 10 has the side sealing portion 30 and the gusset sealing portion 63, which have been subjected to the sealing process by thermal welding. On the other hand, a steam release pouch 10 of a modification has a side sealing portion 30 and a gusset sealing portion 63, which have been subjected to at least one of impulse sealing, high-frequency sealing, and ultrasonic-wave sealing.

The content sealing pouch 1 accommodates sauce in the internal space 19 as the content 80. On the other hand, a content sealing pouch 1 of a modification accommodates medical equipment or a feeding bottle as the content 80.

DESCRIPTION OF THE REFERENCE NUMERALS

1 Content sealing pouch
2 Content sealing pouch
10 Steam release pouch
11 First vertex
12 Second vertex
13 Third vertex
14 Fourth vertex
15 First lateral edge
16 Second lateral edge
17 Upper edge
18 Lower edge
19 Internal space
20 Bag body
21 First bag portion
22 Second bag portion
23 First lateral section
24 Second lateral section
25 Upper portion
26 Sealable portion
27 Opening
28 Cuttable portion
28A Notch
28B Guide line
30 Side sealing portion
40 First side sealing portion
41 First upper side portion
41A First graspable portion
41B First intermediate portion
41C Inner edge
42 First vapor passage portion
42A Left recessed portion
42B Inner edge
42C First opening
43 First intermediate side portion
43A Inner edge
50 Second side sealing portion
51 Second upper side portion
51A Second graspable portion
51B Second intermediate portion
51C Inner edge
52 Second vapor passage portion
52A Right recessed portion
52B Inner edge
52C Second opening
52A Inner edge
52B Second opening
53 Second intermediate side portion
53A Inner edge
60 Bottom gusset
61 Gusset lateral section
62 Gusset lower portion
63 Gusset sealing portion
70 Maximum expandable portion
80 Content
100 Filler
110 Chuck
120 Nozzle
200 Steam release pouch
310 Vapor passage portion
400 Recessed portion
410 First recessed portion
411 Upper portion
411A Upper outer edge
412 Lower portion
412A Lower outer edge
413 Bottom portion
420 Second recessed portion
421 Bottom portion
421A First outer edge
421B Second outer edge
421C Bottom outer edge
430 Opening
500 Seal device

What is claimed is:

1. A steam release free-standing container comprising a bag body and a bottom gusset, the steam release free-standing container having a widthwise direction and a height direction, wherein the bag body has a side sealing portion, which is an end in the widthwise direction and has been subjected to a sealing process, and a sealable portion, which is an upper end in the height direction and has not been subjected to a sealing process, the bottom gusset has a gusset sealing portion, which is an end in the widthwise direction and is a lower end in the height direction and has been subjected to a sealing process, the side sealing portion has an upper side portion, a vapor passage portion, and an intermediate side portion and is formed continuously in order of the upper side portion, the vapor passage portion, and the intermediate side portion from the upper edge of the bag body, the bag body has a cuttable portion between the sealable portion and the vapor passage portion in the height direction, in the cuttable portion, the bag body has been weakened in a line to form a guide line that facilitates cutting of the bag body, the vapor passage portion has a recessed portion recessed toward an inside of the bag body in the widthwise direction of the bag body, a distance between an inner edge of the recessed portion of the vapor passage portion and a maximum expansion center, which is a center of a maximum expandable portion of the bag body is shorter than a distance between an inner edge of the upper side portion and the maximum expansion center and shorter than a distance between an inner edge of the intermediate side portion and the maximum expansion center, the recessed portion has a first recessed portion and a second recessed portion, the first recessed portion has an upper portion contiguous with the upper side portion, a lower portion contiguous with the intermediate side portion, and a bottom portion contiguous with the upper portion and with the lower portion, the second recessed portion has a bottom portion that is a tip of the recessed portion facing the bag body, the second recessed portion is formed contiguously with the bottom portion of the first recessed portion and has an area smaller than an area of the first recessed portion, the upper portion of the first recessed portion is inclined inward toward the bottom portion and has a first sealing width, the lower portion of the first recessed portion is inclined inward toward the bottom portion and has a second sealing width, the bottom portion of the second recessed portion has a third sealing width in the widthwise direction, and the third sealing width is smaller than the first sealing width and smaller than the second sealing width.

2. The steam release free-standing container according to claim 1, wherein an upper outer edge that is an outer edge of the upper portion is formed contiguously with an outer edge of the upper side portion, and includes a linear shape that inclines downwardly in the height direction toward an inside of the widthwise direction, a lower outer edge that is an outer edge of the lower portion is formed contiguously with an outer edge of the intermediate side portion and includes a linear shape that inclines upwardly in the height direction toward an inside of the widthwise direction, the second recessed portion additionally has a first outer edge and a second outer edge, the first outer edge is formed contiguously with the upper outer edge and the outer edge of the bottom portion of the second recessed portion and includes a linear shape that extends in the widthwise direction, and the second outer edge is formed contiguously with the lower outer edge and the outer edge of the bottom portion of the second recessed portion and includes a linear shape that extends in the widthwise direction.

3. The steam release free-standing container according to claim 1, wherein in the cuttable portion, the bag body has been half-cut in a line to form the guide line.

4. The steam release free-standing container according to claim 1, wherein the cuttable portion has a notch, on a lateral edge of the steam release free-standing container, disposed at an endpoint of the guide line.

5. The steam release free-standing container according to claim 1, wherein the first sealing width is a closest distance between an outer edge of the upper portion of the first recessed portion and an internal space of the steam release free-standing container, the second sealing width is a closest distance between an outer edge of the lower portion of the first recessed portion and the internal space, and the third sealing width is a distance, in the widthwise direction, between an outer edge of the bottom portion of the second recessed portion and the internal space.

* * * * *